US010808432B2

(12) United States Patent
Kilian

(10) Patent No.: US 10,808,432 B2
(45) Date of Patent: Oct. 20, 2020

(54) HOLDING ELEMENT FOR A DOOR HANDLE DEVICE

(71) Applicant: Huf Hülsbeck & Fürst GmbH & Co. KG, Velbert (DE)

(72) Inventor: Marion Kilian, Velbert (DE)

(73) Assignee: Huf Hülsbeck & Fürst GmbH & Co., KG, Velbert (DE)

( * ) Notice: Subject to any disclaimer, the term of this patent is extended or adjusted under 35 U.S.C. 154(b) by 390 days.

(21) Appl. No.: 15/576,406

(22) PCT Filed: Apr. 25, 2016

(86) PCT No.: PCT/EP2016/059200
§ 371 (c)(1),
(2) Date: Nov. 22, 2017

(87) PCT Pub. No.: WO2016/188689
PCT Pub. Date: Dec. 1, 2016

(65) Prior Publication Data

US 2018/0155966 A1 Jun. 7, 2018

(30) Foreign Application Priority Data

May 22, 2015 (DE) ..... 10 2015 108 193

(51) Int. Cl.
*E05B 79/20* (2014.01)
*E05B 79/06* (2014.01)
(Continued)

(52) U.S. Cl.
CPC ..... *E05B 79/20* (2013.01); *E05B 77/04* (2013.01); *E05B 79/06* (2013.01); *E05B 79/22* (2013.01)

(58) Field of Classification Search
CPC ..... E05B 79/20; E05B 79/22
(Continued)

(56) References Cited

U.S. PATENT DOCUMENTS 2,425,992 A * 8/1947 Cadwallader ..... F16C 1/101 464/52
5,001,912 A * 3/1991 DeWalch ..... G01R 11/04 292/256.6
(Continued)

FOREIGN PATENT DOCUMENTS

CN 104372987 A 2/2015
DE 102007025359 A1 * 12/2008 ..... E05B 85/18
(Continued)

OTHER PUBLICATIONS

Examination Report dated Jul. 26, 2019, of counterpart European Application No. 16719834.0, along with a Summary of the Office Action in English.
(Continued)

*Primary Examiner* — Carlos Lugo
(74) *Attorney, Agent, or Firm* — DLA Piper LLP (US)

(57) ABSTRACT

A holding element includes a door handle that actuates a door lock and the door handle support at a vehicle with at least a first and second retainer that fixes the holding element at the door handle support and at least a fastener that fastens a mechanical connection element for the actuation of the door lock wherein at least the first retainer serves for the form-fitting fixation of the holding element at the door handle support.

20 Claims, 4 Drawing Sheets

Figure 1:
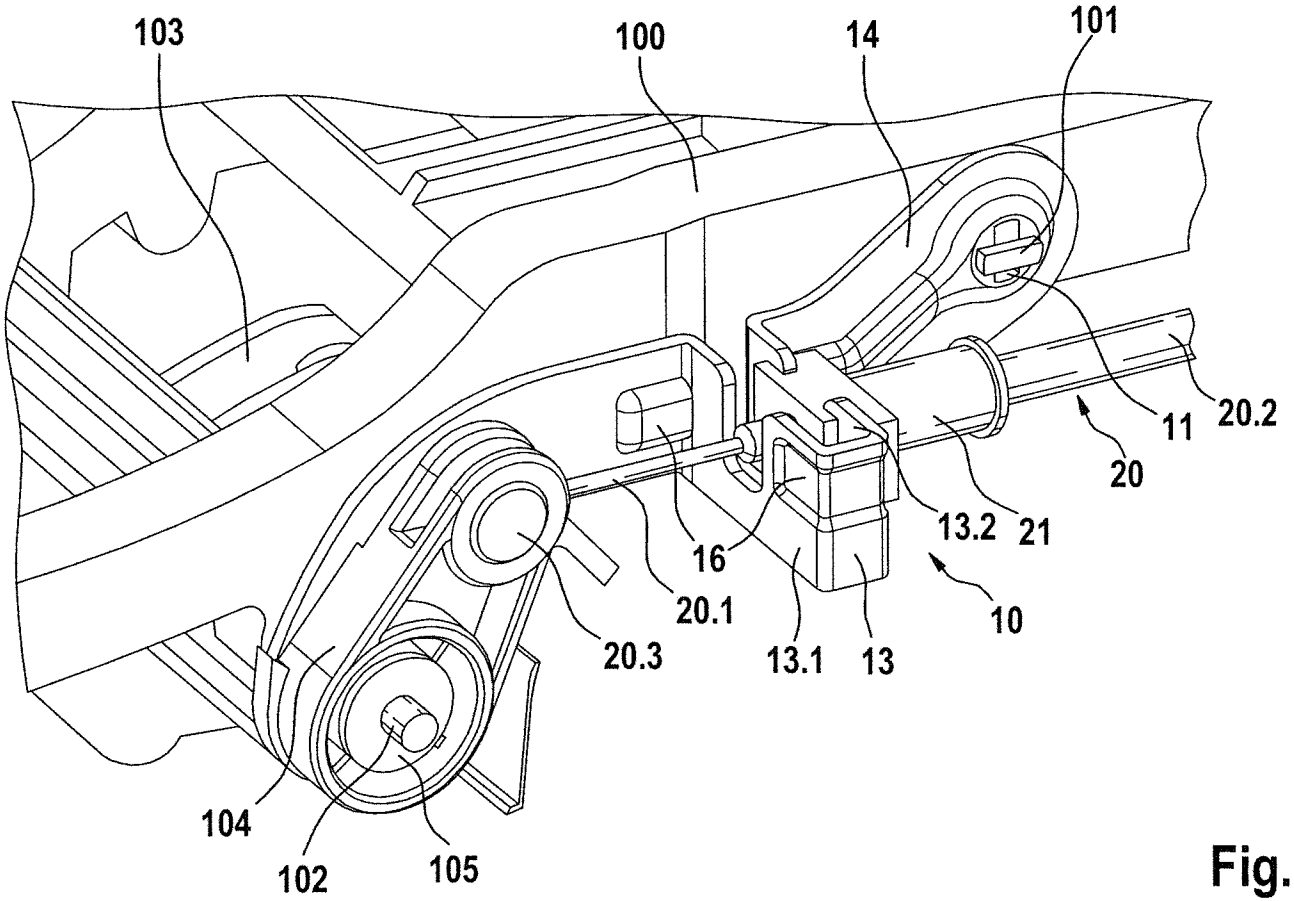

(51) Int. Cl.
*E05B 77/04* (2014.01)
*E05B 79/22* (2014.01)

(58) Field of Classification Search
USPC ..... 74/500.5, 501.6, 502.2
See application file for complete search history.

(56) References Cited

U.S. PATENT DOCUMENTS

| | | | | |
|---|---|---|---|---|
| 5,150,933 | A * | 9/1992 | Myslicki | E05B 83/16 292/216 |
| 5,272,934 | A * | 12/1993 | Chegash | F16C 1/105 24/136 L |
| 5,542,722 | A * | 8/1996 | DeWalch | E05B 65/0089 292/256.6 |
| 5,553,818 | A * | 9/1996 | Wild | B60R 16/0222 248/56 |
| 5,579,662 | A * | 12/1996 | Reasoner | F16C 1/105 74/502.4 |
| 5,615,584 | A * | 4/1997 | Irish | F16C 1/105 248/27.3 |
| 5,927,895 | A * | 7/1999 | Watanabe | F16B 45/02 403/353 |
| 6,178,599 | B1 | 1/2001 | Worden et al. | |
| 6,398,271 | B1 * | 6/2002 | Tomaszewski | E05B 81/06 292/201 |
| 6,971,816 | B2 * | 12/2005 | Miyagawa | F16C 1/105 248/74.1 |
| 7,475,924 | B2 * | 1/2009 | Meyer | E05B 77/04 248/200 |
| 7,766,398 | B2 * | 8/2010 | Umino | E05B 83/36 292/216 |
| 8,376,424 | B2 * | 2/2013 | Bejune | E05B 77/04 292/336.3 |
| 8,727,287 | B2 * | 5/2014 | Trouve | F16C 1/105 248/49 |
| 8,789,860 | B2 * | 7/2014 | Beck | E05B 77/10 292/201 |
| 8,813,428 | B2 | 8/2014 | Zagromski | |
| 8,899,640 | B2 * | 12/2014 | Bertolotti Potachin | E05B 77/06 292/336.3 |
| 9,567,769 | B2 * | 2/2017 | Zimmer | E05B 77/04 |
| 2003/0038486 | A1 | 2/2003 | Nomura et al. | |
| 2011/0308172 | A1 | 12/2011 | Schidan et al. | |
| 2016/0168882 | A1 * | 6/2016 | Chung | E05B 79/20 292/92 |

FOREIGN PATENT DOCUMENTS

| | | | | |
|---|---|---|---|---|
| DE | 202013100996 | U1 * | 4/2013 | F16C 1/262 |
| DE | 102013206889 | A1 * | 10/2014 | F16C 1/262 |
| DE | 102017108921 | A1 * | 10/2018 | E05B 79/20 |
| FR | 2876077 | A1 * | 4/2006 | E05B 79/06 |
| FR | 2 926 837 | A1 | 7/2009 | |
| FR | 2926314 | A1 * | 7/2009 | E05B 79/20 |
| GB | 2 286 441 | A | 8/1995 | |
| JP | 53133824 | A * | 11/1978 | E05B 79/20 |
| JP | 54-016053 | A | 2/1979 | |
| WO | 2010/012422 | A1 | 2/2010 | |

OTHER PUBLICATIONS

First Office Action dated Jan. 16, 2019, of counterpart Chinese Application No. 201680029452.X, along with an English translation.

Notification of the Second Office Action dated Sep. 3. 2019, of counterpart Chinese Application No. 201680029452.X, along with a Summary of the Office Action in English.

Notification of the Third Office Action dated Mar. 23, 2020, of counterpart Chinese Application No. 201680029452.X, along with a Summary of the Office Action in English.

European Office Action dated May 18, 2020, of counterpart European Application No. 16719834.0, along with a Summary of the Office Action in English.

* cited by examiner

HOLDING ELEMENT FOR A DOOR HANDLE DEVICE

The present invention relates to a holding element, particularly for a door handle device and a door handle support for a door handle of a vehicle and a method of assembling a holding element.

It is known that door handle supports which are arranged at the inner side of the door of a vehicle which serve for the acceptance of a door handle comprise an acceptance for a connecting element, wherein the connecting element is connected with a mechanic door lock such that the door can be opened. With door handle supports from a plastic injection molding the acceptance for the connecting element is injected at the door handle support and therewith configured from one material. In case of a vehicle accident, the acceptance for the connecting element can break apart due to the crash such that false alarms of the door lock can occur which in the worst case can lead to an undesired opening of the door.

It is the object of the present invention to at least partially avoid the previously described disadvantages. Particularly it is the object of the present invention to increase the safety and to minimize the false alarms of the door lock such that the positioning of the connecting element remains unaltered even in case of a vehicle accident.

According to the invention the holding element comprises at least one first and one second retaining means for fastening of the holding element at the door handle support and at least one fastening means for fastening a mechanic connecting element for the actuation of the door lock. Thereby, at least the first retaining means serves for form-fitting fastening of the holding element at the door handle support. Likewise, it is possible that the second retaining means of the holding element is fixed and/or arranged at the door handle support. The leading element according to the invention is particularly intended for the door handle device which comprises a door handle for a particularly mechanic actuation of a door lock and a door handle support for a vehicle. The first and second retaining means serve for a secure fastening of the holding element at the door handle support, wherein both retaining means are preferably assembled spaced apart to one another at the holding element. The fastening means serves for the acceptance and fastening of the mechanic connecting element which is also connected with the holding element. In case a force for the actuation of the door handle is performed and transferred via the connecting element, the door lock is actuated (meaning opened) and a door of a vehicle can thereupon be opened. The holding element as an additional component thereby enables an increased break resistance related to the known solutions from the state of the art by the form-fitting fastening of the holding element with the at least first retaining means at the door handle support. Thereby the connecting element is reinforced according to exceptional applications of force via the fastening means of the holding element for example following a crash. Therewith, it is achieved by the configuration of the holding element and the arrangement of the door handle support according to the invention that maloperations of the mechanic door lock due to a material failure of the holding element for the connecting element are nearly prevented. Even a mechanic rupture or a severe deformation in or at the door handle support by a crash has no direct effect on the separate holding element and therewith does not lead to a malfunction of the door lock by the connection element. Therewith, the safety can be significantly increased.

An essential feature for an increased safety is the form-fitting fasting of the at least first retaining means of the holding element at the door handle support wherein a secure positioning of the connecting element at the door handle support is achieved. The form-fit between the holding element and the door handle support occurs by a homogenous (meaning geometrically complementary) configuration of the retaining means and the door handle support such that these two connecting partners do not release with an existing of not existing force transmission.

According to the invention it is possible that at least the fastening means is arranged between the first retaining means and the second retaining means and particularly configured from one piece with the holding element. Due to the arrangement of the fastening means between the two retaining means it can be ensured that the holding element can optimally receive forces acting at the connecting element during an actuation of the door lock via which the connecting element attached at the fastening means. The fastening means can thereby be arranged in the center between the first and second retaining means such that between the fastening means and the first or second retaining means the same lever results for force/momentum transfer, respectively. Further, it is possible that the fastening means is arranged closer to the first or closer to the second retaining means. Thereby, it is achieved that the at least one lever for the force/momentum transfer between the fastening means and the first or second retaining means is decreased and the other lever is increased accordingly. Therewith it can be achieved that in the direction of the increased application of force the corresponding lever between the fastening means and the respective retaining means is dimensioned in the way that the lever action (leverage) will be accordingly small such that the resulting forces/moments are not further increased. It is particularly advantageous for the stability when the fastening means is configured from one part with the holding element. Therewith further weak points which can be a disadvantage with an exceptional force effect can be further reduced. Hereby, it is possible that the fastening means and the holding element are configured from one material (monolithic), wherein a cost-efficient production can be achieved and at the same time a sufficient breaking resistance is existent. Further, it is possible that the fastening means and the holding element are configured from different components and are connected as joined partners particularly as materially bonded wherein different components with different component properties have an influence on the resistance of the holding element. Thereby, the fastening means and the holding element can comprise different breaking resistances or bending resistances, ductilities, melting points, yield strengths or tensile strengths. Thereby, the components can be chosen in dependence of the desired stability or due to the expenses factor.

Within the scope of the invention it is possible that the holding element comprises a first and at least a second arm wherein particularly the arms are arranged in one (common) level. The first and the at least second arm thereby serves for the power intake which can be transferred by the force exerted to the fastening means by the connecting element such that the force from the fastening element of the holding element can be transferred to the door handle support. The arms thereby extend preferably in a right angle away from the fastening means such that one arm extends in a direction from the fastening means and the other arm in the other direction away from the fastening means. It is particularly advantageous when the arms are arranged in one level such that the force transmission proceeds along this level.

According to the invention it is possible that the holding element and/or at least one arm is configured at least nearly arched and/or angled. This means that the holding element per se and/or the at least one arm comprises a geometry which is configured arch-like and/or angled. Hereby, it is possible that the at least one arm which extends from the fastening means extends circular arch-like from the fastening means. Angled within the sense of the invention means that the holding element and/or the at least one arm extends stepwise from the fastening means. Both embodiments can be configured in horizontal as well as in vertical direction viewed from the fastening means. Thus, in the course of the holding element an offset in the geometric configuration can be existent wherein at the offset for example the fastening means is arranged. The geometry of the holding element or the at least one arm can be adapted to the necessary geometry accordingly for example at the door handle support. This can be an advantage for space required purposes such that the door handle support can be configured possibly compact and/or near to the door handle carrier and at the same time an optimal rigidity is achievable. Further, the holding element can be adapted to the form of the door handle support accordingly, such that a simplified installation or assembly of the door handle support is enabled.

Within the scope of the invention at least the first retaining means can be arranged at the first arm and the at least second retaining means arranged at the second arm, particularly, a plurality of retaining means can be arranged at the first arm and/or the second arm, particularly displaced to one another. In case one retaining means is arranged at one arm respectively and the fastening means is arranged between the first and the second arm with a respective retaining means, it is ensured that the application of force to the fastening means can be optimally transferred to the holding element and therewith to the door handle support. The retaining means can be arranged at any position along the first or second arm. Advantageously, however, they are arranged such that an optimal component geometry and/or an optimal breaking resistance is achieved. Thereby a fastening of the holding element by the first or second retaining means in direct vicinity of the fastening means represents a fastening possibility with which the least force transfer element acts to the holding element or fastening means. It can be particularly preferred when a plurality of retaining means are arranged at the first and/or second arm, particularly displaced to one another. Therewith depending on the stress at the respective arm a plurality of retaining means can be arranged such that an increased stability and/or safety is enabled by a plurality of holding points of the holding element at the door handle support. Thereby it can be an advantage when the retaining means are arranged displaced to one another at the respective arm. This serves particularly with an angled and/or arch-like configuration of the arms of the holding element to the fact that multiple force transfer points of the holding element at the door handle support are existent.

It can be intended according to the invention that at least one retaining means is configured for the acceptance of an axis, particularly an axis of rotation from the door handle support. Such a configuration of the retaining means enables a simple and fast assembly of the holding element at the axis of the door handle support or at the door handle support itself, since the retaining means and therewith the holding element only need to be slided on the axis. Accordingly, the retaining means results in a homogenous pair of surfaces with the axis which configures a form-fitting connection. Hereby, the pair of surfaces is configured from two cylinder areas coaxial to one another such that a form-fit result in all directions of the area perpendicular to the cylinder axis. In case the axis is thereby configured as a axis of rotation of the door handle support, the assembly of the holding element at the door handle support is further facilitated. Thereby, it is enabled that the holding element is attached to the axis of rotation with the at least one retaining means and is turned about this axis such that at least the second retaining means is arrangeable at a further position of the door handle support. Further it is possible that the retaining means is secured via a retaining ring and/or splint with the axis of rotation of the door handle support particularly form- and/or force-fittingly.

According to the invention the at least one retaining means can be configured as an opening (breakthrough) with a circular or star-like or rectangular cross section, particularly configured as a polygon-like opening. The opening which serves as a retaining means in the holding element can thereby be configured according to the individual application such that a facilitated assembly and/or a reduction of the degrees of freedom of movement can be achieved. In case the opening is configured circular, the holding element can be turned about the circular retaining means wherein the assembly is facilitated. With a star-like, polygonal or polygon-like opening an axial movement about the retaining means is prevented such that a final assembly position is achievable. Thereby, malpositions during the assembly of the holding element at the door handle support can be prevented as far as possible. Thereby, the opening can comprise different diameters or material strengths of the holding element during its course. Thereby for example further clipsing effects can be achieved.

Within the scope of the invention it is possible that at least the one (particularly the first) retaining means can be configured as a bayonet joint and/or plug connection and/or rotating connection and/or clips connection and/or resting connection, particularly as a complementary acceptance of a counter retaining means at the door handle support. A bayonet joint enables a fast establishable and detachable mechanic connection of the two connecting partners, wherein a form-fitting connection is established or separated by turning the connecting partners against one another of. Thereby, the retaining means can be secured in two axes against a releasing. A plug connection enables a fast and simple assembly of the holding element at the door handle support which can be established cost-efficiently and can be mounted tool-free. A rotating connection enables a secure connection which is configured free of play for a reliable arrangement at the door handle support. By a clips connection a fast establishable and releasable mechanic connection can be established which is establishable and releasable tool-free such that a fast assembly and disassembly is achievable. A resting connection of both connecting partners namely the retaining means with the door handle support achieves a form-fitting connection which for example is establishable with multiple steps via different resting steps. Particularly preferred is a retaining means as a complementary acceptance of a counter retaining means at the door handle support. Therewith, two connecting partners result which preferably form-fittingly enable an optimal force transfer and therewith a secure connection. Thereby, the retaining means (respectively, particularly the first) can be connected with the counter retaining means at the door handle support form-fittingly and/or additionally materially bonded. It is particularly preferred when the retaining means is configured such that it is arrangeable tool-free at the counter retaining means at the door handle support.

Within the scope of the invention it is possible that at the fastening means an adapter is arranged for the acceptance of the connecting element, wherein the connecting element is connected with the fastening means. Thereby, the adapter is form- and/or force-fittingly connected with the connecting element and with the fastening means. Accordingly, the connecting element can be connected with the fastening means of the holding element such that a reversible assembly of the adapter at the fastening means is performable.

Further, it is possible that the adapter is configured from one piece and/or from one material with the connecting element, particularly with the fastening means. Thereby, a configuration from one piece of the adapter with the connecting element and therewith a form-fit, force-fit or material bond between the two connecting partners is established such that an optimal force transfer can be established with a high rigidity at the same time. A configuration of the adapter from one material with the connecting element improves and simplifies the production of the two components such that such that a cost-efficient production is facilitated. In a preferred embodiment the adapter can be configured from one piece and/or one material (monolithic) with the fastening means, wherein further costs can be saved during the production. Thereby, the adapter and/or the connecting element and/or the fastening means can be configured from a plastic and/or metallic component and/or a composite material.

Within the scope of the invention it is further possible that the adapter is configured as an end sleeve and/or clamp and/or screw connection for the connecting element. In case the adapter is configured as an end sleeve it can be for example attached to the edge of the connecting element such that the diameter of the connecting element is increased due to the end sleeve, wherein a form-fit of the end sleeve with the fastening means can be achieved. Thereby, the end sleeve can be arranged on the connecting element such that by a crimping of the end sleeve this is connected form- or force-fittingly with the connecting element. The adapter can likewise be configured as a clamp wherein for example a clamp is force-fittingly connected with the connecting element via a spring such that the clamp is configured form-fittingly and/or force-fittingly with the connecting element and the fastening means.

Further, it can be provided within the scope of the invention that the adapter and/or the fastening means comprise a resting connection and/or a clips connection and/or a plug connection and/or a rotary joint and/or a screw connection or a combination thereof wherein the adapter is connectable to the fastening means. Thereby, the same advantages result like they are already described according to the configuration of the retaining means and the counter retaining means.

Within the scope of the invention it is further possible that the holding element and/or the fastening means comprise reinforcing elements, particularly in form of shaping or reinforcing ribs. The reinforcing elements are thereby preferably arranged at the holding element and/or fastening means such that the mechanical properties related to the break resistance and stability are improved. The reinforcing elements can thereby be achieved by deforming the holding element and/or the fastening means and/or by integrally shaping of additional material at the holding element and/or the fastening means such that at the corresponding positions which are particularly strained higher mechanical rigidities can be achieved. Further, additional material at the holding element and/or fastening means can be existent in form of reinforcing ribs. Thereby, the reinforcing ribs can be configured from the same material and/or the same compound with the holding element and/or the fastening means.

It can be an advantage when the holding element comprises a metallic component and/or a composite material. A metallic component is mainly characterized in that at the same time a high ductility of the component is achievable with a cost-efficient production. Further metallic components can be easily formed or casted such that an arch-like and/or angled geometry of the holding element is cost-efficiently producible. Further, the holding element can comprise a composite material, wherein advantageously this is a fiber composite, particularly carbon fiber reinforced plastic, glass fiber reinforced plastic, aramid fiber reinforced plastic or metal-matrix composite material. By a composite material different material properties of the single components can be combined with one another such that the material properties of the composite material can be used by the different advantages of the single materials. The connection of the different materials thereby occurs by material bond and/or form-fit. Therewith, it can be application-specifically attempted to combine the different advantages of the single materials in the final component and therewith to minimize the disadvantages of the single components.

Within the scope of the invention it is possible that the holding element is a stamp component and/or a bent component, particularly galvanized and/or coated with a plastic, particularly foiled. A stamp component or a bent component can be produced particularly cost-efficient since the metallic components can be configured in the desired form by a deformation process. With a metallic stamp component and/or bent component it is particularly preferred when those are galvanized and/or coated or covered with a plastic such that the chemical properties of the component are further increased and protected against environmental influences. Thus, a metallic component which is galvanized can be for example protected against oxidation. Likewise, a plastic can thereby protect the metallic component against environmental influences and at the same time improve the metallic properties of the component. It can be particularly cost-efficient when the stamp- and/or the bent component is foiled and therewith covered with a plastic layer. Thereby, the possibility exists to coat the component with a spray film after the deformation process and to protect it therewith against environmental influences.

Preferably it can be intended that the holding element comprises material recesses, particularly that the holding element is configured as a frame construction. The material recesses provide for a weight reduction of the holding element wherein due to the material recesses at the same time a cost-efficient production of the holding element can be achieved. Particularly, the holding element can be configured as a frame construction such that in dependence of the desired rigidity of the holding element the geometry of the holding element can be adjusted accordingly. Accordingly, this is about a frame construction which can only be configured by single reinforcing ribs for the optimal rigidity.

Within the scope of the invention it can be provided that the fastening means is configured U-like, particularly that two legs are arranged to one another such that the adapter is at least sectionally form-fittingly and/or force-fittingly connectable to the legs. With a U-like configuration of the fastening means the fastening means can be simply configured by a deformation of the holding element such that particularly cost-efficiently the fastening means is configured at the holding element. It is particularly preferred when two legs are arranged to one another such that the adapter is at least partially force-fittingly and/or form-fittingly connectable to the legs. It is thereby possible that the two legs are arranged parallel to one another and seamlessly merge into the two arms of the holding element. Therewith the holding element is configured from one piece, wherein at the same time the adapter can be optimally force-fittingly and/or form-fittingly arranged between the two legs.

The connecting element serves for the mechanic transfer of the movement from the door handle to the door lock and can preferably be configured as a Bowden cable (tension sleeve and core) in order to achieve a high functionality with a high flexibility at the same time. Further, it is possible that the connecting element is configured as a rope, chain or wire or in form of a rod with possibly one or multiple joints, wherein preferably a cover is provided with the so called connecting elements.

According to a further aspect of the invention a door handle support is claimed with a holding element according to the invention. The door handle support is arranged at the inner side of the door and serves for the acceptance and/or bearing of the door handle. At the door handle support the holding element according to the invention is arranged such that the holding element is fixed form-fittingly at the door handle support with at least one retaining means. The connecting element is fixed at the holding element such that the connecting element comprises a mechanic connection with the door lock and thus the door can be opened. The door handle support according to the invention with a holding element according to the invention is particularly characterized in that the safety of the door handle support and the holding element are significantly improved during an accident since the break resistance and the deformation resistance of the holding element are increased such that a maloperation by a malfunction of the connecting element which is arranged at the fastening means of the holding element can be at least reduced. Therewith, it is prevented that in case of an accident the holding element is damaged and the door can be opened by itself. Thereby, the door handle support according to the invention is configured such that the holding element is form-fittingly connected with at least a retaining means. The at least one further retaining means is likewise arranged at the door handle support such that at least two retaining means a force-fitting connection can be established. Therewith, it is ensured that the connecting element is securely retained at the fastening means and therewith at the holding element such that a safe positioning of the connecting element is ensured even in case of an accident.

Within the scope of the invention it is possible that at the door handle support at least a counter retaining means is arranged to the retaining means, wherein particularly the counter retaining means is configured complementary to the retaining means. The counter retaining means arranged at the door handle support is thereby configured such that at least one retaining means a form-fitting connection can be established. Thereby, the counter retaining means serves for a save connection of the holding element with the door handle support and at the same time for a simple assembly and the correct positioning of the holding element at the door handle support such that with such a safety relevant component in the vehicle no defective assembly and therewith malfunction during operation occurs. Particularly preferred, the counter retaining means is geometrically complementary configured to the retaining means. This means that the counter retaining means and the retaining means are configured such that both connecting partners are configured as male or female connecting partner and therewith together configure a bayonet joint and/or a plug connection and/or rotary joint and/or clips connection and/or resting connection. With a bayonet joint one of the connecting partners possesses for example a longitudinal slit and the other part a head-like configured counterpart, which can be introduced into the longitudinal slit and is connected by a plug rotating movement with one another. Therewith, the two connecting partners are force- and form-fittingly connected with one another and at the same time saved against undesired releasing of the connecting partners by interlocking and opposing turning. A plug connection exists when the connecting pair is provided for example from two cylinder areas, co-axial to one another, which can be plugged into one another, wherein this can comprise a pin/axis and a hole or a material recess. In case two connecting partners are configured as a rotating connection the retaining means and the counter retaining means are twisted against each other such that a force and/or form-fitting connection results. A clips connection can be described as a spring-clip, wherein the at least one retaining means is configured such that it comprises a spring-clip such that the two connecting partners are interlocking such that a secure retaining is established by the self-locking of the retaining means and the counter retaining means. Hereby, a force-fitting connection of both connecting partners results which is characterized by a short assembly time and a reversible assembly. With a resting connection the retaining means and/or the counter retaining means configures a cavity and/or a recess or a cut-out, in which the connecting partners can engage, wherein the connecting partner is configured such that preferably a connection is form-fittingly connected with a greater extent, since not only a radial form-fit results, but further in its longitudinal direction a form-fit can be at least partially effected.

It is possible that the door handle support comprises at least one axis, wherein the at least one retaining means is arrangeable at the axis. The axis thereby serves for the acceptance of a cut-out such that the retaining means is mounted pivotably about the axis of the door handle support. Thereby, the axis can be configured such that the axis extends to the retaining means such that further components can be arranged on the axis.

It is further possible that with a door handle support according to the invention a bearing-link is provided, which is movably arranged at the door handle support. Preferably, this bearing-link is arranged pivotably about an axis of rotation, wherein this axis of rotation serves at the same time for the acceptance and arrangement of the holding element according to the invention. This bearing-link acts mechanically with a movable door handle and is actuated by an actuation of the door handle (by its user). This movement is preferably realized by a swivel or turning movement, wherein the connecting element is actuated. For this purpose a projecting element for the connecting element is provided at the bearing-link, particularly for a connecting nipple of a core of a connecting element configured as a Bowden cable. This projecting element is configured lever-like and rotates preferably with the movement of the bearing-link (particularly directly) about said axis of rotation. This projecting element is rigidly, particularly torque-proofly, connected with the bearing link. Preferably, the bearing-link is configured as a mass-balancing-weight and can preferably interact with a latch in form of a crash interlock at the door handle support. Said door handle can be configured as a pan bar or pulling handle or as a combination handle from a pan bar or pulling handle.

It is further possible that the door handle support is a plastic injection molding part, particularly a glass fiber reinforced injection molding part. The production of the door handle support from a plastic by an injection molding part method enables a cost-efficient and at the same time weight optimized production. Thereby, by the injection molding part all elements of the door handle support can be randomly formed such that at the same time a material saving and stable door handle support is producible. Thereby, it is possible that the plastic injection molding part is produced from multiple different composite material components such that at different component parts different composite material properties are applicable.

According to a further aspect of the invention a method for the assembly of a holding element at the door handle support of a vehicle is claimed. The method according to the invention comprises at least the following steps:

- Accepting or plugging on a first retaining means of the holding element at a counter retaining means of the door handle support
- rotating of the holding element about the counter retaining means of the first retaining means particularly between 10° and 180° about the counter retaining means of the first retaining means
- fastening of the second retaining means at an axis of the door handle support The method steps are subsequently described in detail using an example wherein the invention is not restricted to this example. In case the retaining means and the counter retaining means are connecting partners in form of a bayonet joint in the first step the first retaining means can be fit (tool-free) to the counter retaining means, wherein the retaining means comprises a long hole, which is configured complementary to the counter retaining means. Thereby, the counter retaining means is configured head-like (with a beam-like head) and comprises nearly the same geometric extensions as the retaining means at the holding element. In a further step the holding element is rotated about the counter retaining means at the door handle support, such that the long hole of a retaining means is pivoted against the fixed head of the counter retaining means, such that a form- and/or force-fitting connection of the holding element or the retaining means at the counter retaining means and therewith at the door handle support is established. In a further step after rotating of the holding elements against the counter retaining means, the second retaining means is arranged at an axis of the door handle support, particularly plugged on. Therewith, a tool-free assembly of the holding element at the door handle support is enabled. Thereby, a fast and at the same time error avoiding and possibly tool-free assembly of the holding element at the door handle support is achieved, such that the safety is ensured by a correct assembly of the two assembly partners.

According to a further aspect of the invention a door handle system is claimed, wherein the door handle system is configured from a door handle support according to the invention, a holding element according to the invention, a connecting element, the door lock and a door handle, such that a safe door handle system is claimed, which in case of an accident keeps its functionality and malfunctions are prevented nearly. With the door handle support, the method for the assembly of the holding element and the door handle system all advantages result which are already described for the holding element according to the invention.

Figure 2:
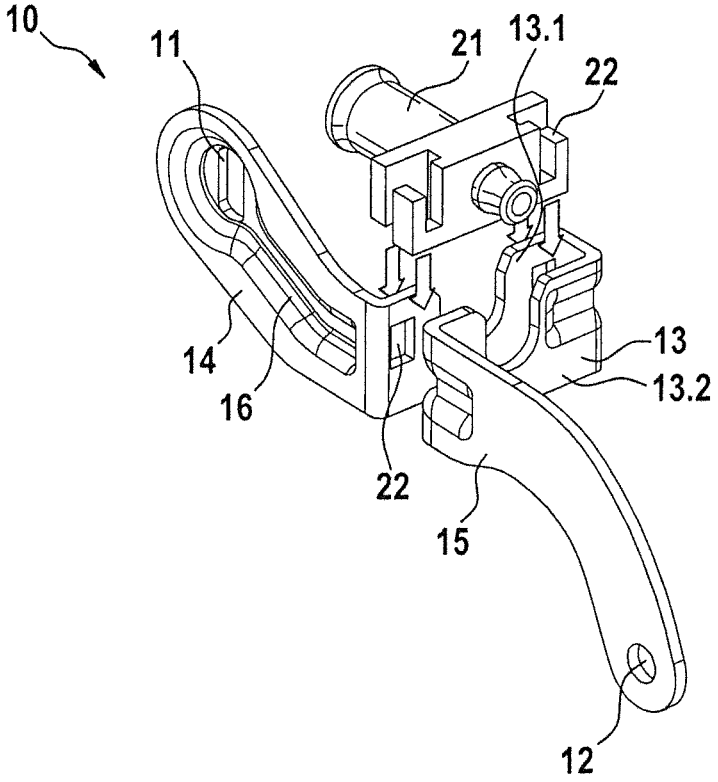
Figure 3:
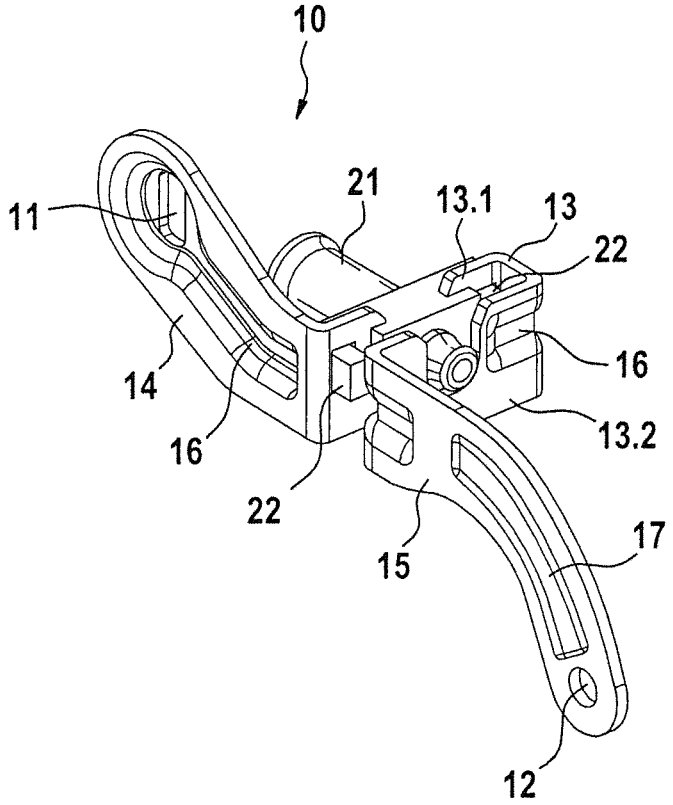
Figure 4:
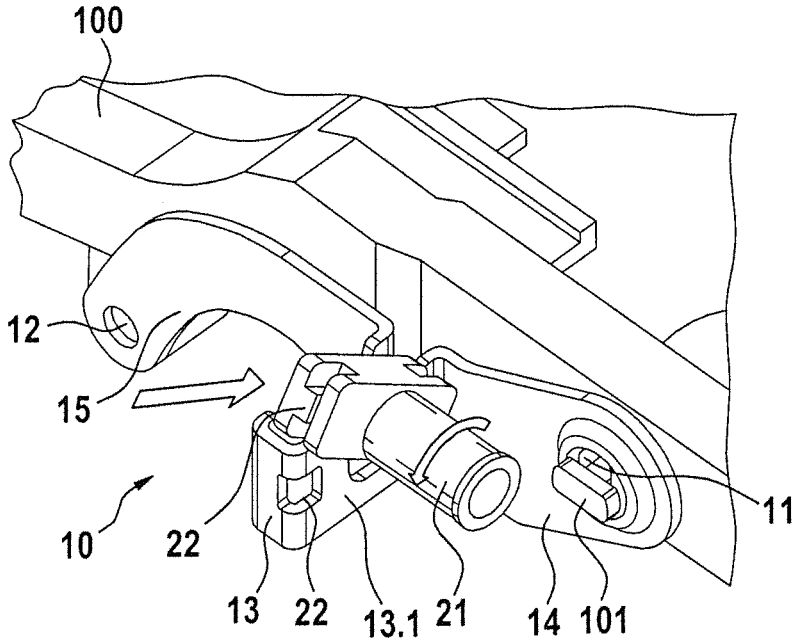
Figure 5:
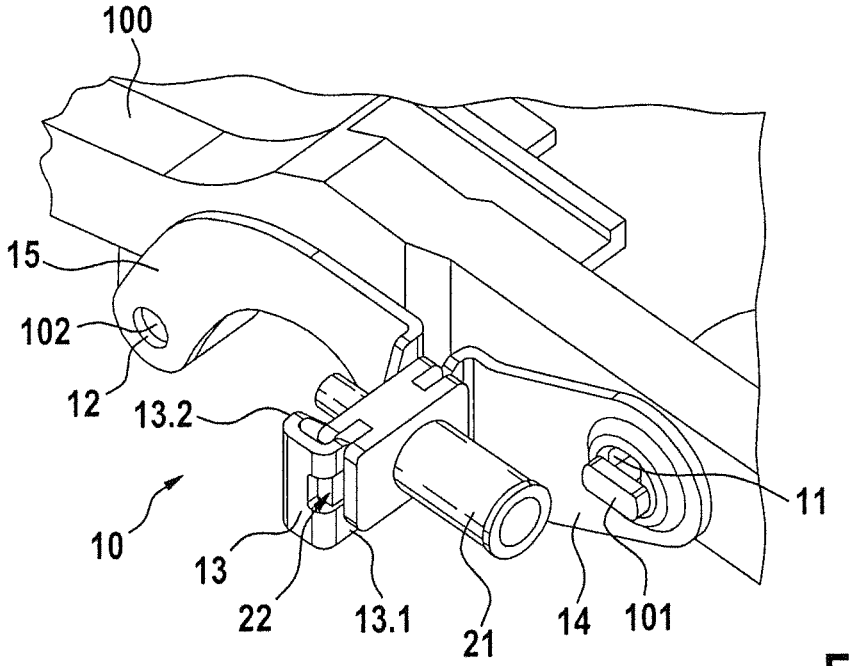
Figure 6:
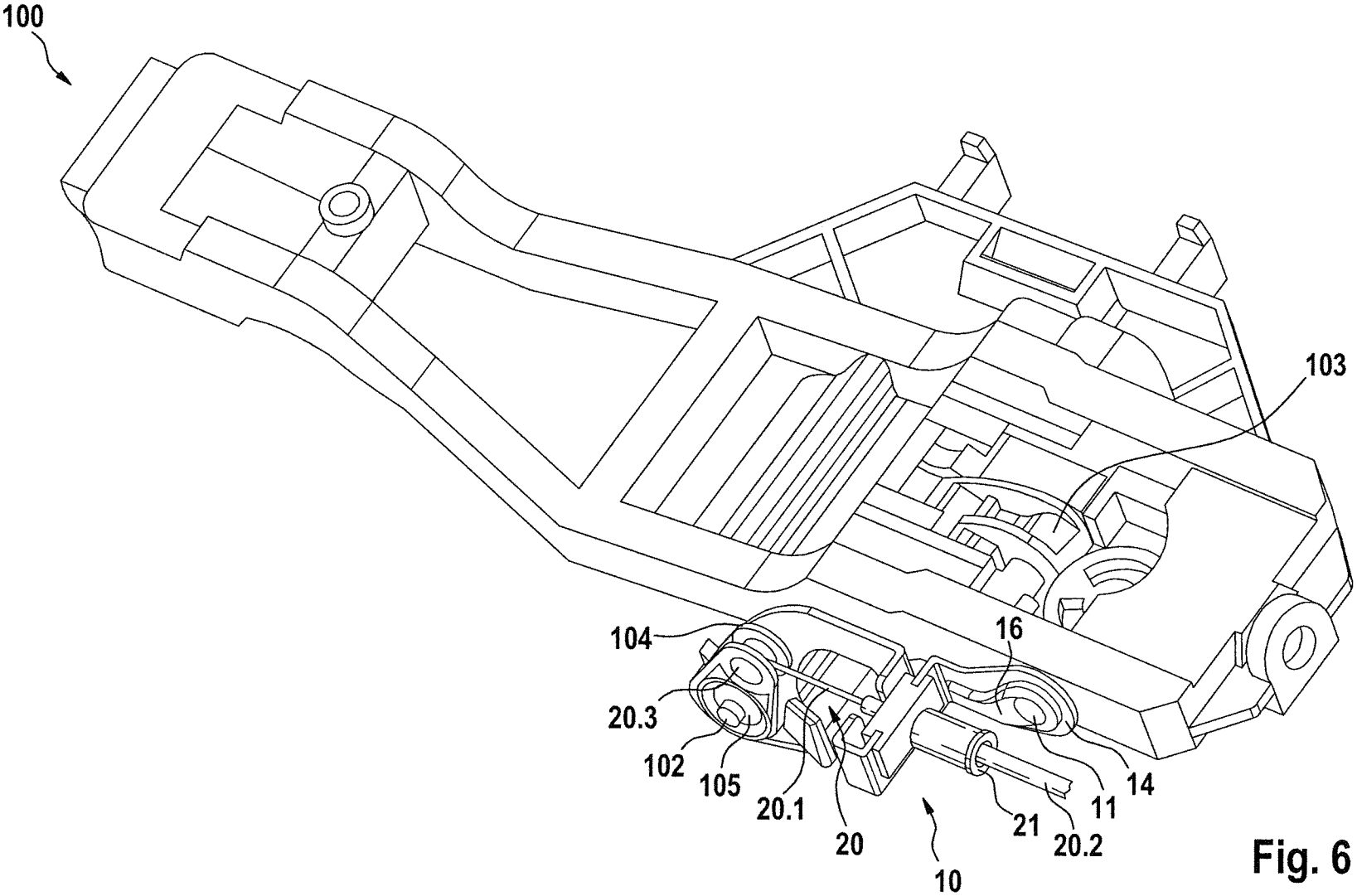

Further measures improving the invention result from the subsequent description to some embodiments of the invention, which are schematically shown in the figures. All features and/or advantages known from the claims, the description or the drawings including constructive details, spatial arrangements and method steps can be essential for the invention each single by themselves or in any combination. Thereby, it has to be considered that the figures have only descriptive character and are not intended to limit the invention in any form. It is shown schematically:

FIG. 1 a door handle support according to the invention with a first embodiment of the holding element according to the invention, FIG. 2 a first embodiment of the holding element according to the invention, FIG. 3 an embodiment of the holding element according to the invention with a mounted adapter, FIG. 4 a door handle support according to the invention with a holding element according to the invention, FIG. 5 a door handle support according to the invention with a holding element according to the invention, FIG. 6 a configuration according to the invention of the door handle support according to the invention with a holding element according to the invention.

Technical elements and features with the same function and mode of operation comprise the same reference signs in FIGS. 1 to 6, respectively. This is why they are only described once.

In FIG. 1 a first embodiment of the holding element 10 according to the invention is shown schematically, which is assembled at a door handle support 100 according to the invention. The holding element 10 thereby comprises two arms 14, 15, wherein at the end of the first arm 14 the first retaining means 11 and at the second arm 15 the second retaining means 12 is arranged. Between the first arm 14 and the second arm 15 the fastening means 13 is arranged, wherein the fastening means 13 comprises a first leg 13.1 and a second leg 13.2. The two legs 13.1, 13.2 are thereby arranged parallel to one another such that the adapter 21 is mounted between the two legs. Thereby, the adapter 21 comprises at least a form and force fitting connection with the at least one leg 13.1. At the adapter 21 the connecting element 20 is arranged, which is connected with a further component of the door handle system, wherein the further component is arranged at the axis 102, at which the second retaining means 12 of the holding element 10 is arranged. At the holding element 10 and the fastening means 13 reinforcing elements 16 are formed, which serve for a further reinforcement of the holding element 10 and the reinforcing element 16. Thereby, particularly at the first arm 14 reinforcing elements 16 are mounted, which extend from the first retaining means 11 to the fastening means 13. The first retaining means 11 is thereby configured as a bayonet joint with its connecting partner the counter retaining means 101 at the door handle support. The first retaining means 11 is configured as a long hole at the first arm 14 of the holding element 10, which is assembled about the head-like configured counter retaining means 101 of the door handle support. Thereby, the holding element 10 is pivoted about 90° during the assembly of the counter retaining means 101. Therewith, the head-like configured counter retaining means 101 and the first retaining means configured as a long hole establish a form- and force-fitting connection. The second retaining means 12 of the second arm 15 is thereby plugged onto the axis 102 of the door handle support. Thereby, the axis 102 of the door handle support 100 is configured such that a further component, particularly a projection element 104 of the door handle system is arrangeable on the axis. The holding element 10 and/or the further component in form of the projection element 104 for the end of the connecting element 20 can be secured and/or fixed on the axis of rotation 102 by a securing ring 105. Further, the fastening means 13 can comprise material formations at its first leg 13.1 and its second leg 13.2 such that the connecting element 20 or a part of the adapter 21 are guidable by these material formations of the fastening means 13. The adapter 21 comprises an acceptance for the sleeve 20.2 of the connecting element 20 configured as a Bowden cable. In this acceptance of the adapter 21 a breakthrough for a sleeve 20.2 of the Bowden cable is provided, wherein the core 20.1 is guided within the sleeve 20.2. The end of the core 20.1 is equipped with a connecting nipple 20.3 and is connected with the projection element 104 of the door handle support 100 in order to enable to transfer a mechanic actuation of the door handle to a door lock.

In FIG. 2 an embodiment of the holding element 10 according to the invention is shown. The holding element 10 comprises thereby two arch-like arms 14 and 15, wherein at the end of the first arm 14 a first retaining means 11 and at the end of the second arm 15 a second retaining means 12 are arranged respectively. The perspective of FIG. 2 shows a holding element in contrary to the lateral perspective shown in FIG. 1, which directs to the door handle support 100. Thereby, the reinforcing elements 16, particularly at the first arm 14, are known. The second retaining means 12 is configured at the second arm 15 as a material breakthrough, such that an axis 102 of the door handle support can be received in this material breakthrough. The fastening means 13 is configured seamless with the two arms 14, 15 in FIG. 2, such that a U-like configuration of the legs 13.1 and 13.2 of the fastening means 13 results. At the first end of the legs 13.1 and 13.2 the first arm 14 and the second arm 15 extend respectively in an angle of 90° from the fastening means. Likewise, at the fastening means 13 hereby reinforcement elements 16 are configured. Further, the adapter 21, which is configured with the clips connection 22 can be configured as a plastic injection molding part. The clips connection is thereby configured by two material formations 22 configured as spring elements at the adapter 21, which can be clipped into complementary configured acceptances 22 at the fastening means 13 of the holding element 10. Thereby, the arrows in FIG. 2 which extend perpendicularly from the adapter 21 in the direction of the fastening means 13 show how the adapter 21 can be arranged in the fastening means 13. Thereby, the adapter 21 is pushed into the fastening means 13 from the top, wherein the spring elements 22 of the adapter 21 are snapped in or clipped in to the complementary configured acceptance 22 of the fastening means 13 via force application. The first arm 14 and the second arm 15 are configured arch-like in FIG. 2, wherein the extension directions of the arms 14, 15 are configured opposing to one another.

In FIG. 3 the holding element according to the invention is shown, wherein the adapter 21 is in the clipsed position in FIG. 3. Further, in FIG. 3 a material recess 17 is shown at the second arm 15. In contrast to the first arm 14 at which the reinforcing elements 16 are arranged it is possible at the second arm 15 due to the different loads to perform the material recess 17. Therewith, further weight and material can be saved. Further, it is shown how the clips connection 22 of the adapter 21 engages into the complementary configured acceptance 22 of the fastening means 13, particularly in the first leg 13.1 of the fastening means 13. Thereby, a force- and form-fitting connection of the adapter 21 results with the fastening means 13, particularly with the first leg 13.1 of the fastening means 13.

FIG. 4 shows a detail of the door handle support 100 according to the invention, wherein the holding element 10 according to the invention is assembled at the counter retaining means 101 of the door handle support 100. The configuration or assembly possibility of the adapter 21 at the fastening means 13 should be particularly emphasized in FIG. 4. Thereby, the adapter 21 is initially pushed by a horizontal movement into the fastening means 13 and in a next step pivoted about the longitudinal axis of the adapter such that the two connecting partners of the clips connection 22 can engage with one another. In the shown position the holding element 10 is in an already mounted position and therewith form-fittingly connected with a first retaining means 11 with the counter remaining element 101 of the door handle support 100 with the retaining means 11. Thereby, the first retaining means 11 and the counter remaining means 101 like already described in FIG. 1 are configured as a bayonet joint. The second retaining means 12 of the second arm 15 is thereby configured as a breakthrough for the acceptance of an axis of the door handle support 100 like already described in FIG. 1.

In FIG. 5 an embodiment of the holding element 10 is shown which is already shown in FIG. 4. In FIG. 5 the adapter 21 however is already in the assembled position at the fastening means 13. The at least one part of the adapter 21 is arranged between the two legs 13.1 and 13.2 of the fastening means 13. Further, it is shown in FIG. 5 that by the different orientations of the arch form of the first arm 14 and the second 15 the geometry of the holding element 10 is adjusted to the geometry of the door handle support 100. The U-like configured geometry of the fastening means 13 at the holding element 10 enables that the connecting element 20 can proceed in parallel to the door handle support 100. Thereby, a force progression which is in the same axis/level in which the holding element 10 is form- and force-fittingly assembled at the door handle support via the retaining means 11 and 12.

In FIG. 6 the door handle support 100 according to the invention is shown. Hereby, the holding element 10 is form-fittingly connected at the first retaining means 11 with the door handle support 100. The second retaining means 12 is hereby assembled on the axis 102 of the door handle support for the bearing link 103. The bearing link 103 itself can be configured as a mass balancing weight for the movable door handle. Likewise, the connecting element 20 is shown which extends from the adapter 21 to a further component, the projecting element 104 of the door handle system wherein the further component is arranged on the axis 102 of the door handle support. The door handle support 100 is thereby part of the door handle system, wherein the door handle support 100 is arrangeable at the inside of a door of a motor vehicle, wherein in or at the door handle support 100 a mechanic lock cylinder and a door handle mechanism (particularly partly in form of a bearing link 103) is arrangeable. The connecting element 20 thereby serves for the force progression between the door handle, particularly the door handle mechanism and the door lock. The connecting element 20 is like shown in FIG. 6 configured as a Bowden cable with a core 20.1 and a sleeve 20.2 which is force- and form-fittingly connected with the adapter 21. The end of the connecting element 20 meaning the connecting nipple 20.3 of the core 20.1 is thereby pivotably received in a further component, namely the protection element 104, which is configured at least torque-proof or monolithic with the bearing link 103 which is tightly assembled on the axis 102 of the door handle support 100.

REFERENCE LIST

10 Holding element
11 First retaining means

12 Second retaining means
13 Fastening means
13.1 Leg
13.2 Leg
14 First arm
15 Second arm
16 Reinforcing element
17 Material recess
20 Connecting element
20.1 Core, particularly from wire
20.2 Sleeve, particularly sprain solid
20.3 Connecting nipple for 20.1
21 Adapter
22 Clips connection
100 Handle support
101 Counter retaining means
102 Axis, particularly for 103
103 Bearing link, particularly with mass balancing weight
104 Protection element for 20, particularly lever-like
105 Securing ring

The invention claimed is:

1. A holding assembly configured to be assembled at a door handle support of a vehicle door handle operatively connected to a door lock, the holding assembly comprising:

a holding element comprising a first arm having a first retaining means and a second arm having a second retaining means, the first and second retaining means fixing the holding element at the door handle support, a fastening means between the first and second arms, and an adapter arranged within the fastening means between the first and second arm, the adapter being configured to accept a portion of a mechanical connecting element for actuation for the door lock by the door handle, and defining opposite clip connections configured to be received into the fastening means, wherein the first retaining means serves for the form-fitting fixation of the holding element at the door handle support, and the adapter is angularly moveable into the fastening means to engage the fastening means and then pivotable about a longitudinal axis of the adapter to engage the other one of the clip connections with the fastening means.

2. The holding element according to claim 1, wherein the first or second arms are mainly arched or angulated.

3. The holding element according to claim 1, wherein at least one of the retaining means is arrangeable on an axis.

4. The holding element according to claim 1, wherein at least one of the retaining means is configured at breakthrough with a circular or star or multi-angular cross section.

5. The holding element according to claim 1, wherein the connecting element is connected to the fastening means.

6. The holding element according to claim 5, wherein the adapter is configured at least from one piece or one material with the connecting element.

7. The holding element according to claim 5, wherein the adapter is configured at least as an end sleeve or clamp or screw connection for the connecting element.

8. The holding element according to claim 5, wherein at least the adapter or the fastening means comprises at least a resting connection or a clips connection or plug connection or a rotary joint or a screw connection or a combination thereof, and the adapter is connectable with the fastening means.

9. The holding element according to claim 1, wherein at least the holding element or the fastening means comprise reinforcing elements.

10. The holding element according to claim 1, wherein the holding element comprises a metallic component or a composite material.

11. The holding element according to claim 1, wherein the holding element is at least a stamped part or a bent component.

12. The holding element according to claim 1, wherein the holding element comprises a material recess.

13. The holding element according to claim 5, wherein the fastening means is configured in a U shape.

14. A door handle support for a door handle of a vehicle comprising the holding element according to claim 1.

15. The door handle support according to claim 14, wherein, at the door handle support, at least a counter retaining means is arranged to the retaining means.

16. The door handle support according to claim 14, wherein the door handle support comprises at least one axis, and at least one retaining means is arrangeable at the axis.

17. The door handle support according to claim 14, wherein the door handle support is a plastic injection molding part.

18. A method of assembling the holding assembly of claim 1 at the door handle support of a vehicle comprising:

a) accepting or plugging in the first retaining means of the holding element at a counter retaining means of the door handle support, b) rotating of the holding element about the counter retaining means of the first retaining means, and c) arrangement of the second retaining means at an axis of the door handle support.

19. The holding element according to claim 1, wherein the at least one retaining means is configured as a complementary recess of a counter retaining means at the door handle support.

20. The holding element according to claim 7, wherein the connecting element is at least force-fittingly or form-fittingly receivable in the adapter.

* * * * *